US005976037A

United States Patent [19]

Watson

[11] Patent Number: 5,976,037

[45] Date of Patent: Nov. 2, 1999

[54] HEAD MOVEMENT RESTRAINING DEVICE FOR BASEBALL BATTERS

[75] Inventor: Tom Watson, Rome, Ga.

[73] Assignee: Mid South Baseball Association, Rome, Ga.

[21] Appl. No.: 09/014,613

[22] Filed: Jan. 28, 1998

[51] Int. Cl.[6] ..... A63B 69/36

[52] U.S. Cl. ..... 473/458; 473/208

[58] Field of Search ..... 473/208, 458, 473/211, 268, 266, 274, 275

[56] References Cited

U.S. PATENT DOCUMENTS 1,126,051 1/1915 McGillicuddy ..... 473/208

2,461,826 2/1949 Krautter ..... 473/208

5,651,680 7/1997 Levy ..... 473/208 X

*Primary Examiner*—George J. Marlo

*Attorney, Agent, or Firm*—Thomas, Kayden, Horstemeyer & Risley, L.L.P.

[57] ABSTRACT

A training device to assist a player in maintaining proper head position and visual contact with a ball, during a swing of a club, racket, or bat, for example. In the preferred embodiment, the present invention includes a mouth piece which is secured by a person's teeth and a spring loaded attachable mechanism clamped to the person's jersey. A cord connects the mouth piece to the attachable mechanism and provides resistance to any head movements which place the cord in tension. Accordingly, the person maintains better head positioning during the swing.

5 Claims, 1 Drawing Sheet

HEAD MOVEMENT RESTRAINING DEVICE FOR BASEBALL BATTERS

FIELD OF THE INVENTION

The present invention generally relates to training devices and, more particularly, to a device used for maintaining positive head position and proper eye contact when making contact with a ball. The device is particularly suited for use in connection with, for example but not limited to, a player using the present invention to achieve better head position in the sports of golf, tennis, and baseball.

BACKGROUND

There are many situations when it is desirable for a person to maintain a particular head position when attempting to make contact with an object. Maintaining a desirable head position increases visual contact with an object and, therefore, increases a person's overall performance when participating in a sporting activity. For example, it is well recognized in the game of baseball that it is very important for the player to make eye contact with a ball from the time the ball is thrown by the pitcher to the time the ball reaches the zone or area where the batter swings to hit the ball. A baseball player can experience great difficulty in hitting a ball, especially when the player's head is moved to an undesirable position where the player's head faces away from the contact point. As a consequence of the undesirable head position, the player many times is unable to make proper visual contact and, therefore, engage the ball during the swing.

A prior art device, U.S. Pat. No. 4,300,765 of Stringham, discloses a batting aide comprising a shoulder piece and a jaw piece. These two pieces are inter-connected and located between the batter's chin and shoulder. The relative pressure exerted by the device during a swing by the batter indicates whether or not the batter's head and shoulder are in the proper position. Another prior art patent, U.S. Pat. No. 3,697,065 of Socci, discloses another prior art training device for hitting a baseball. The device comprises a shoulder harness with a chin holder connected thereto. This device also connects a player's chin and shoulder and causes the player's head to move from the front shoulder to the back shoulder during the course of the swing.

These prior art devices suffer from various deficiencies and inadequacies that are not present in this invention. For example, the devices in both Stringham and Socci connect the head to the shoulders or upper torso and do not hold the head in the best ball striking position. In this regard, the head should rotate relative to the shoulders during the swing to attain the proper ball striking position. However, the devices disclosed in both Stringham and Socci impede this type of motion. In addition, the aforementioned devices do not prevent the player from the undesirable head movement associated with pulling up and/or pulling backwards during the swing.

Thus, a heretofore unaddressed need exists in the industry for a simple and inexpensive device that aids substantially in overcoming the above mentioned deficiencies to achieve the desired result.

SUMMARY OF THE INVENTION

The present invention is a training device for maintaining proper head position and eye contact with a ball during a sport swing. In the preferred embodiment, the present invention is a device which attaches to a person's clothing at a particular point and to a mouth piece, with an elastic cord attached to each for resistance. The mouth piece, which is attached through the elastic cord to the player's clothing, controls the head movement of the player throughout the sport swing. In other embodiments, the means for connecting the mouth piece to the player's clothing may be an inelastic cord, chain, cloth, or other suitable means for connecting the mouth piece to the player's clothing.

In general, some head movements are more dynamic in losing eye control than others. The present invention targets the player's undesirable head movement associated with lifting up and/or pulling backwards. By adding resistance to a player's head movements in this regard, the player maintains a desirable head position and, therefore, better eye control. This improves a player's ability to hit a ball by allowing the player to see the ball as long a possible.

It is therefore an object of the present invention to provide better eye tracking of an approaching ball by keeping the player's head in better position.

Another object of the present invention is to provide a method used for training eye and head control, when engaged in the movement associated with a sport swing.

Another object of the present invention is to provide an inexpensive device for use while training or playing to increase desirable head positioning.

Another object of the present invention is to provide a small detachable device for easy head control.

Another object of the present invention is to provide a reliable method for helping a player control a particular swing.

Other objects, features, and advantages of the present invention will become apparent to one skilled in the art upon examination of the following detailed description, when read in conjunction with the accompanying drawings. All such additional objects, features, and advantages are intended to be included herein.

BRIEF DESCRIPTION OF THE DRAWINGS

The present invention can be better understood with reference to the following drawings. The drawings are not necessarily to scale, emphasis instead being placed upon clearly illustrating principals of the present invention. Furthermore, like reference numerals designate corresponding parts throughout the several views.

DESCRIPTION OF THE PREFERRED EMBODIMENT

The features and principals of the present invention will now be described relative to a preferred embodiment thereof. It will be apparent to those skilled in the art that numerous variations or modifications may be made to the preferred embodiment without departing from the spirit and scope of the present invention. Thus, such variations and modifications are intended to be included herein within the scope of the present invention, as set forth in the claims.

Figure 1:
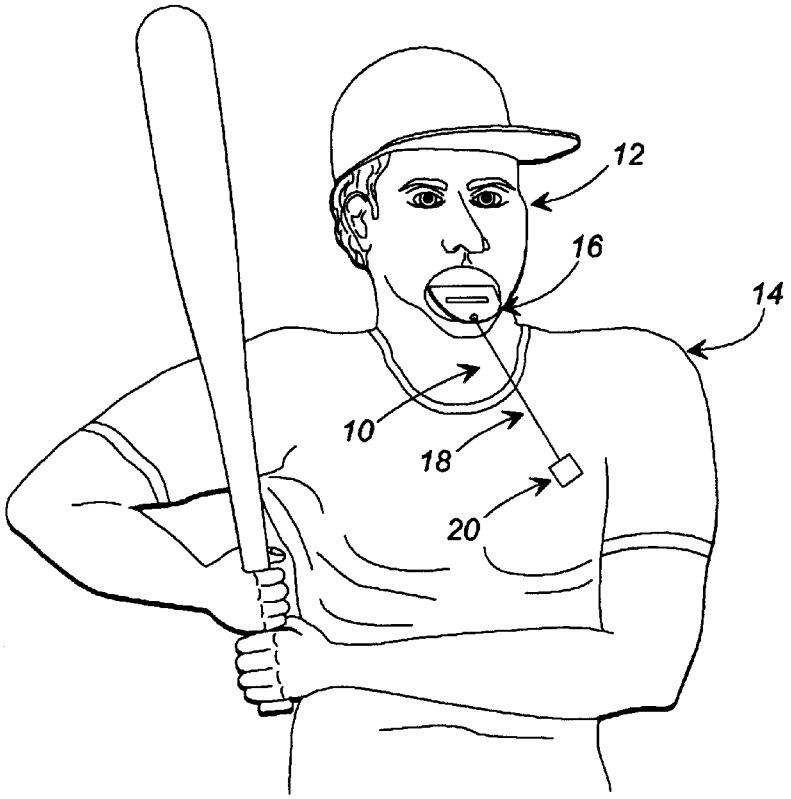
FIG. 1 is a view of a player equipped with the preferred embodiment of the training aide of the present invention.

Referring now in more detail to the drawings, FIG. 1 is an illustration of a batter or a player 12, wearing a jersey 14 as clothing, equipped with the preferred embodiment of the training aide or device 10. The preferred embodiment of the training aide 10 generally comprises a mouth piece 16 for controlling the player's head movement, when attached through a cord 18 to a particular position of a player's clothing 14. At the player's clothing 14, the invention includes an attachment mechanism 20 for securing the cord 18.

Figure 2:
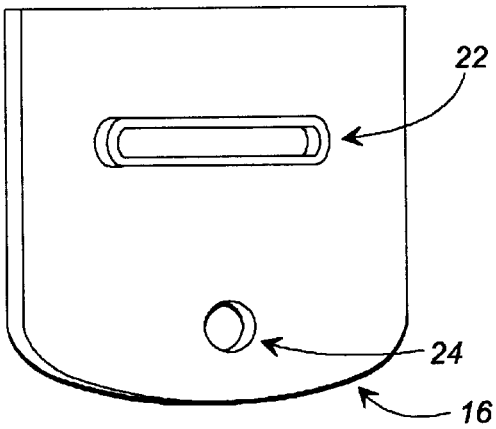
FIG. 2 is an enlarged top view of the mouth piece of the preferred embodiment of the present invention.
Figure 3:
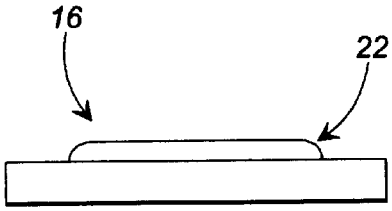
FIG. 3 is an enlarged front view of the mouth piece of the preferred embodiment of the present invention.

An enlarged view of the mouth piece 16 of the present invention is shown in FIGS. 2 and 3. The mouth piece 16 preferably includes a ridge or raised portion 22 for engaging the player's teeth in order to secure the mouth piece 16. Additionally, the mouth piece 16 has an aperture 24 for attaching cord 18. This aperture 24 is preferably outside of the player's 12 mouth when the training aide 10 is in use. In the embodiment shown, the mouth piece 16 is manufactured by an injection molding process. The process includes a mold which is filled with liquid rubber material in the desired shape of the mouth piece 16. Once the material hardens, the mold (preferably in two equal halves) opens and the formed unit is released.

Figure 4:
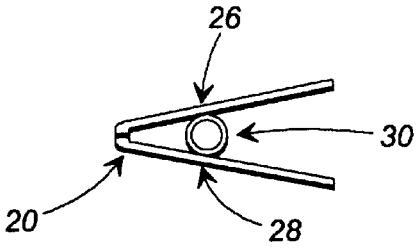
FIG. 4 is a side view of the attachment mechanism of the preferred embodiment of the present invention.

The cord 18 mentioned above, which attaches the mouth piece 16 to the attachable mechanism 20 of FIG. 4, is a cord or string 18 that is available in a variety of materials. Movement of the player's shirt 14 allows the device 10 to move relative to the player 12 to some extent. Therefore, although elasticity is beneficial, any conventional string or cord should be sufficient to implement the principles of the present invention. A principle purpose of the cord 18 is to provide resistance to motion of the player's head in a direction that causes tension in the cord 18. Accordingly, the cord 18 operates as a positioning device for helping to maintain a position of the player's head relative to the object being struck during a swing.

The attachment mechanism 20 for attaching to a player's clothing is preferably a clamp or pin. The attachment mechanism 20 can be configured to include biasing means such as a spring mechanism 30 for easy attachment of the device 10 to a player's jersey 14. By pressing sides 26 and 28 together, the attachable mechanism 20 is configured to open, and a portion of the player's jersey 14 can be inserted between sides 26 and 28. Then, by releasing sides 26 and 28, the spring loaded mechanism 30 is configured to close the attachable mechanism 20, thereby securing the portion of the player's jersey 14 inserted between the two sides 26 and 28. The design of attachable mechanism 20 is well-known in the art, and any conventional attachable mechanism suitable for attaching cord 18 to the player's clothing 14 may be used.

Operation

The preferred use and operation of the sport aide device 10 and associated methodology will be discussed hereafter.

Initially, a player 12 inserts the raised portion 22 of mouth piece 16 into his mouth and secures the sports aide device 10 by engaging the raised portion 22 with the player's teeth. Then, a particular head position is determined which allows the player 12 to effectively view an object such as, for example, a baseball held by another player some distance away. This can be achieved by observing the position of the player's head while the player 12 is maintaining a stance prior to initiating a swing.

Next, the attachment mechanism 20 is attached to the player's jersey 14 at a location far enough away from the mouth piece 16 to ensure that the cord 18 is substantially extended. In this regard, the distance from the attachment mechanism 20 should approximately match the length of the cord 18. Furthermore, the location of the attachment mechanism 20 should be chosen such that the cord 18 will provide resistance to movement of the player's head which tends to cause the player 12 to lose sight of the object of concern (i.e., the baseball, golf ball, tennis ball etc.) prior to the player 12 striking the object. Accordingly, it is preferable to attach the attachment mechanism 20 in a position corresponding with the direction that the player 12 should be facing when contact is made with the object. For example, in FIG. 1, player 12 should be facing in a direction substantially defined by the line formed by cord 18 when the player 12 makes contact with the object. Therefore, attachment mechanism 20 is attached to jersey 14 in the manner depicted by FIG. 1.

With the attachment mechanism 20 attached and the mouth piece 16 secured, the player 12 performs a swing in order to strike the object. During the swing, the tension produced by cord 18 helps to impede any motion of the player's head away from the attachment mechanism 20. Accordingly, the player 12 performs the swing in a more desirable form which allows the player 12 to maintain visual contact with the object being struck.

Therefore, it should be apparent to one skilled in the art that the sport aide device 12 can be a very effective training device. Most players 12 experience performance highs and lows. While many unknown sources cause degraded player 12 performance, one known source is lack of eye control or the ability to see the object clearly during a swing due to undesirable head motion. While some movement is usually necessary for a player to swing a bat or club, excess movement can be a primary cause of inadequate eye control and loss of eye contact with the object. Additionally, some head movements are more dynamic in losing eye control than others. The present invention targets the player's head movement particularly associated with lifting up and/or pulling backwards. By adding resistance to the player's head position with the present invention, the player 12 maintains a desirable head position and, therefore, better visual contact with the object.

Although a particular embodiment of the invention has been illustrated and described, various changes may be made in the form, composition, construction, and arrangement of the parts without sacrificing any of its advantages. Therefore, it is to be understood that all matter contained in the foregoing description or shown in the accompanying drawings shall be interpreted as illustrative only, and not in a limiting sense.

What is claimed is:

1. A baseball training device for maintaining proper head positioning of a batter when swinging a baseball bat, said baseball training device comprising:

a mouth piece having a front end and a rear end, said mouth piece being adapted to be inserted into the batter's mouth and held in place with the batter's teeth such that said rear end is disposed within the batter's mouth and said front end is positioned outside the batter's mouth;

an elongated cord having a first end and a second end, said first end of said cord being connected to said front end of said mouth piece; and a spring loaded clamp for attaching said second end of said cord to a fabric garment worn over the torso of the batter at a point on the fabric garment wherein the cord becomes substantially taught when the batter's head moves away from the proper position.

2. The training device of claim 1, wherein said mouth piece includes a raised portion adapted to engage the person's teeth with which said mouth piece can be held in place.

3. The training device of claim 1, wherein said cord is made of an elastic material.

4. The training device of claim 1, wherein said cord is made of an inelastic material.

5. Baseball training apparatus for training a baseball batter to maintain proper head positioning when at bat, said baseball training apparatus comprising:

a baseball training device, including:

a mouth piece having a front end and a rear end, said mouth piece being adapted to be inserted into the batter's mouth and held in place with the batter's teeth such that said rear end is disposed within the batter's mouth and said front end is positioned outside the batter's mouth, an elongated cord having a first end and a second end, said first end of said cord being connected to said front end of said mouth piece, and a spring loaded clamp for attaching said second end of said cord to a fabric garment worn over the torso of the batter at a point on the fabric garment wherein the cord becomes substantially taught when the batter's head moves away from the proper position; and a baseball bat.

* * * * *